US007334909B2

(12) United States Patent
Williamson

(10) Patent No.: US 7,334,909 B2
(45) Date of Patent: Feb. 26, 2008

(54) UNDERWATER VISIBILITY DEVICE

(76) Inventor: Lila Marie Williamson, 66 Tortuga Cay, Aliso Viejo, CA (US) 92656

( * ) Notice: Subject to any disclaimer, the term of this patent is extended or adjusted under 35 U.S.C. 154(b) by 111 days.

(21) Appl. No.: 11/012,749

(22) Filed: Dec. 15, 2004

(65) Prior Publication Data

US 2006/0124483 A1 Jun. 15, 2006

(51) Int. Cl.
*F21V 33/00* (2006.01)

(52) U.S. Cl. ..... 362/101; 362/96; 362/318

(58) Field of Classification Search ..... 362/23, 362/28, 96, 101, 109, 119, 189, 267, 318; 73/293, 300, 431
See application file for complete search history.

(56) References Cited

U.S. PATENT DOCUMENTS 2,879,381 A * 3/1959 Coffey ..... 362/189
3,828,611 A * 8/1974 Shamlian et al. ..... 73/300
3,868,853 A * 3/1975 Alinari ..... 73/431
4,196,623 A * 4/1980 Alinari ..... 73/300
4,333,348 A * 6/1982 Berninger ..... 73/431

* cited by examiner

*Primary Examiner*—Y. My Quach-Lee
(74) *Attorney, Agent, or Firm*—Dennis W. Beech

(57) ABSTRACT

The underwater visibility device may be used for improved visibility viewing of an underwater device in an underwater diving environment. A closed container may have a flexible portion formed of a relatively transparent material with respect to an underwater device to be viewed. A fluid that may be relatively transparent with respect to the underwater device may be contained in the closed container. The closed container may be attached to the underwater device in a position for viewing the underwater device through the closed container.

14 Claims, 2 Drawing Sheets

UNDERWATER VISIBILITY DEVICE

BACKGROUND OF THE INVENTION

This invention relates to devices that may aid in viewing meters, gauges, computing devices and the like while underwater, such as, when scuba diving or for other underwater operations. The new underwater visibility aid may be a flexible pouch or bag containing a relatively transparent fluid that may be disposed on an outer surface, such as, a lens of a gauge and retained on the gauge.

Gauges, meters, computing device displays and the like have been in use by underwater divers for may years. Such devices may be used to indicate the status of gas breathing tanks, the direction of travel, time underwater, depth and other parameters that may be useful for an underwater diving activity. While viewing such devices underwater may normally be straightforward, in poor visibility conditions, such as, during murky, cloudy or opaque underwater conditions, it may be difficult or impossible for a diver to view a gauge. This may be true even if the diver has a light source. Contemporary technological solutions to such underwater diving visibility problems may have included integrating a small optical display with a diving mask wherein the display may be electronically connected to various monitoring or computer devices.

SUMMARY OF THE INVENTION

The present invention is directed to devices for improved visibility viewing of an underwater device in an underwater diving environment. A closed container may have a flexible portion formed of a relatively transparent material with respect to an underwater device to be viewed. A fluid that may be relatively transparent with respect to the underwater device may be contained in the closed container. The closed container may be attached to the underwater device in a position for viewing the underwater device through the closed container.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
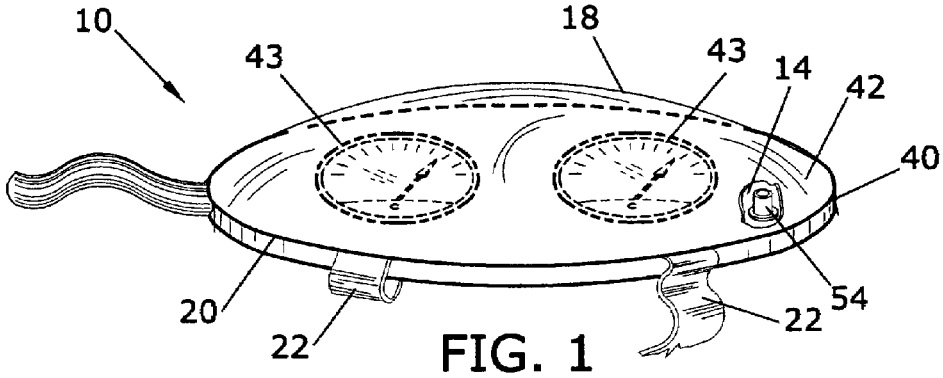
FIG. 1 illustrates a perspective view of a gauge with an underwater visibility device according to an embodiment of the invention.
Figure 2:
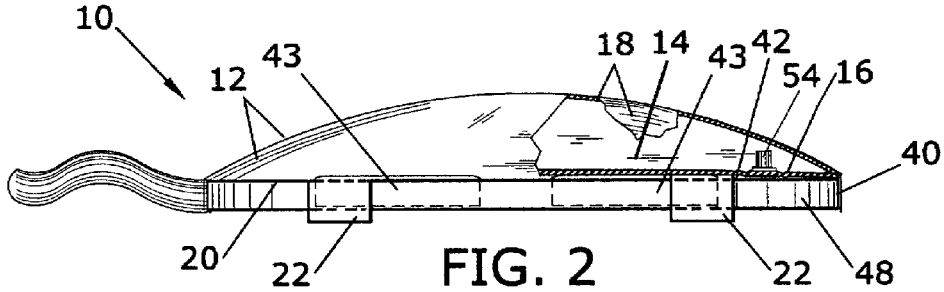
FIG. 2 illustrates a side view of a gauge with an underwater visibility device according to an embodiment of the invention.

Referring to FIGS. 1 and 2, an underwater visibility device 10 may be a closed pouch, bag or container 12 that may be formed of a flexible, optically clear material such as plastic or other suitable material. The bag 12 may be filled with a fluid 14 that may be transparent with respect to an object or device that is to be viewed by a user. Optically clear water or other fluids with sufficient transparency for underwater viewing may be used.

The bag 12 may have a gauge portion 16 and a lens or viewing portion 18. The gauge portion 16 may be placed against the face element 42 of an underwater device 40 that may be a gauge, meter, compass, computer or other underwater device. The face element 42 may be a gauge lens, glass or plastic cover or other underwater device 40 viewing element. The bag 12 may have straps 22 attached at a peripheral edge 20 or other suitable position on the bag 12 for attachment of the bag 12 to a gauge, meter, compass, computer or other underwater device 40. The straps 22 may have a fastener, such as, hook and loop, snaps, buckles and the like for fastening strap 22 elements one to the other that may be positioned around a portion of the underwater device 40. There may be a sealable fluid port 54 disposed in the wall of the bag 12 that may be used to fill or remove fluid 14. The underwater visibility device 10 may be provided to a user without fluid 14 therein and the user may then fill the bag 12 using port 54. A plug or other device may be used to seal or close the port 54.

Figure 5:
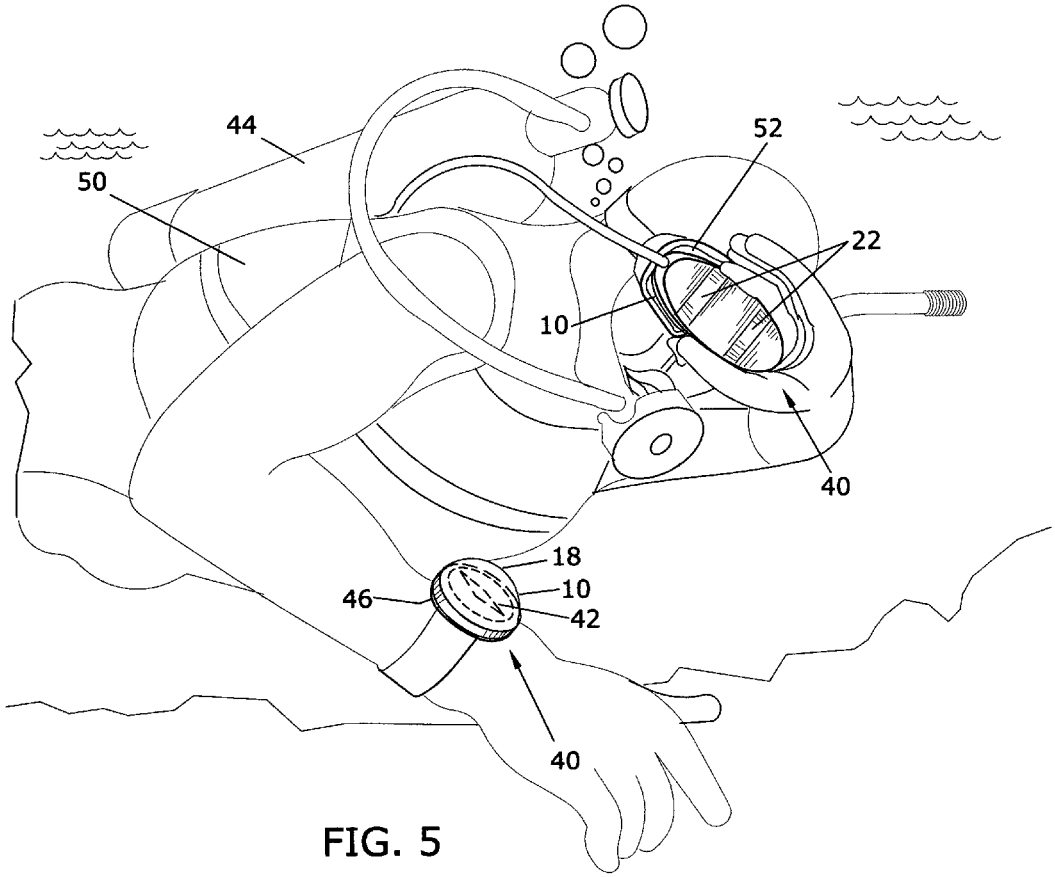
FIG. 5 illustrates an underwater diver viewing a gauge and having a wrist attached device with underwater visibility devices according to an embodiment of the invention.

With the gauge portion 16 positioned against a face element 42 a user may view the underwater device 40 gauge or other indicator through the lens portion 18, fluid 14 and gauge portion 16. The viewing may be done when a diver is underwater and may be particularly useful in underwater conditions that may be murky, clouded, opaque and the like. As best viewed in FIG. 5, a diver 50 may position an underwater device 40 that may indicate the status of breathing tanks 44 or may be a compass 46 against the diving mask lens 52. The underwater visibility device 10 may be pressed against the diving mask lens 52 to displace underwater fluid between the face element 42 and the diving mask lens 52. The diver 50 may then be able to view or read the underwater device 40 through the fluid 14.

Figure 3:
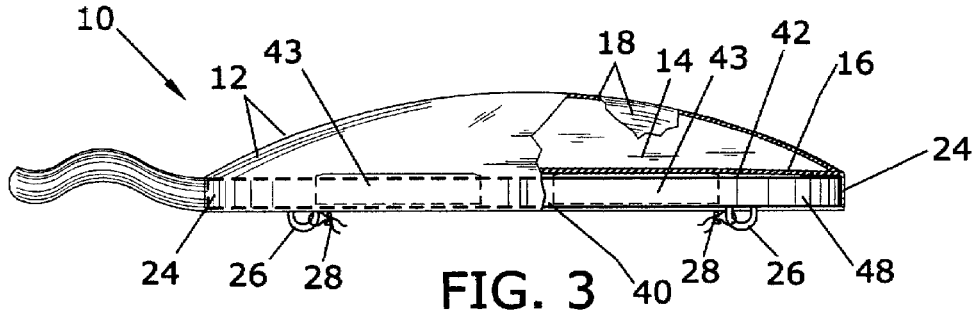
FIG. 3 illustrates a side view of a gauge with an underwater visibility device according to an embodiment of the invention.

Referring to FIG. 3, the underwater visibility device 10 may have a skirt 24 shaped to extend around the side edge 48 of an underwater device 40 when the gauge portion 16 is disposed against the face element 42. There may be attachment elements 26 attached to the underwater device 40 that may be used to secure straps, lines 28 or the like that may be attached to the underwater device 40 or skirt 24. A line 28 may be disposed in a sleeve in the skirt 24 that may allow the line 28 to function as a draw string to tighten the underwater visibility device 10 on the underwater device 40.

Figure 4:
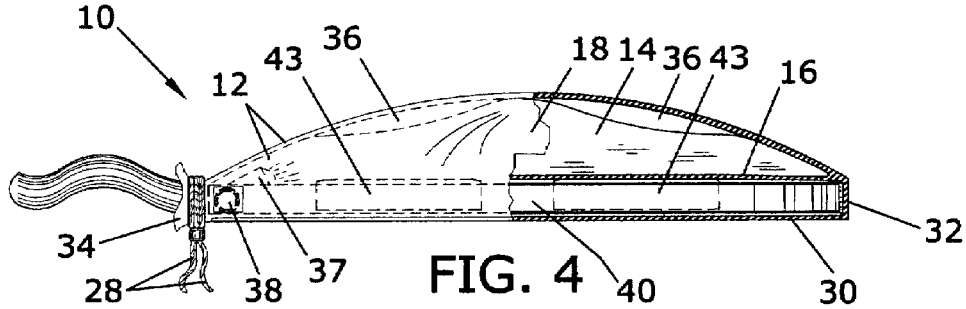
FIG. 4 illustrates a side view of a gauge with an underwater visibility device having optical lenses according to an embodiment of the invention.

Referring to FIG. 4, the underwater visibility device 10 may have a pocket 30 with one end 32 closed formed with the gauge portion 16 that may slide around and enclose an underwater device 40 to retain the underwater visibility device 10 on the underwater device 40. There may be a line 28 for closure of an open end 34.

The lens portion 18 may have one or more refractive lenses 36 formed therein or attached thereto to aid a diver who may require optical corrective lenses to read or view an underwater device 40. There may also be a light source 37 disposed in the underwater device 10. The light source 37 may have an electric power element such as a battery and a switch 38. The switch 38 may be a mechanical switch or a pressure switch. A pressure type switch may activate the light source 37 when the underwater visibility device 10 experiences a pressure increase such as when the underwater visibility device 10 may be pressed against a diving mask lens.

Referring again to FIGS. 1 and 2, the bag or closed container 12 may also be formed by attachment of a flexible lens element 18 to the underwater device 40, for example, to the face element 42. A lens element 18 may be attached to the surface of the face element 42 by adhesive or bonding or may be attached by a mechanical device, for example, a clamping ring. The gauge portion 16 may not then be necessary to contain the fluid 14 as the closed container may be defined by the face element 42 and the lens element 18. The closed container 12 for such a structure may be sized to be the shape of the face of a gauge 43.

While the invention has been particularly shown and described with respect to the illustrated embodiments thereof, it will be understood by those skilled in the art that the foregoing and other changes in form and details may be made therein without departing from the spirit and scope of the invention.

I claim:

1. A device for improved visibility viewing of an underwater device in an underwater diving environment comprising:

a closed container having a flexible portion formed of a relatively transparent material with respect to an underwater device to be viewed;

a fluid that is relatively transparent with respect to said underwater device and is disposed in said closed container; and said closed container is disposed exterior to said underwater device for viewing of said underwater device through said closed container wherein said underwater device is not immersed in said fluid.

2. The device as in claim 1 wherein said closed container comprising a lens member attached to a face element of said underwater device.

3. The device as in claim 1 wherein said closed container comprising a bag having a lens portion and a gauge portion wherein said gauge portion is disposed against a face element of said underwater device.

4. The device as in claim 2 wherein a refractive lens is disposed with said lens member.

5. The device as in claim 4 wherein a refractive lens is disposed with said lens portion.

6. The device as in claim 4 wherein said closed container having a strap for attachment to said underwater device wherein said strap positioned to retain said gauge portion against said face element for viewing of said underwater device through said lens portion, said fluid and said gauge portion.

7. The device as in claim 4 wherein a skirt is attached to said closed container and said skirt shaped and disposed to extend around a side edge of said underwater device when said closed container is disposed thereon.

8. The device as in claim 7 wherein said skirt having a line disposed in a sleeve formed therein for attachment of said closed container to said underwater device.

9. The device as in claim 8 wherein said underwater device having an attachment element for attachment of said line.

10. The device as in claim 4 wherein a pocket is formed with said gauge portion wherein said pocket encloses said underwater device and has a closure at an open end to retain said closed container on said underwater device.

11. The device as in claim 10 wherein said open end closure is a line.

12. The device as in claim 1 wherein a light source with a switch is disposed in said closed container.

13. The device as in claim 12 wherein said switch is a pressure activated switch.

14. The device as in claim 1 wherein there is a sealable port in the container.

* * * * *